US005172606A

United States Patent [19]

Dzioba et al.

[11] Patent Number: 5,172,606

[45] Date of Patent: Dec. 22, 1992

[54] MODULE COCKPIT/SUPPORT STRUCTURE WITH ADJUSTABLE PEDALS

[75] Inventors: Donald L. Dzioba, Midland; Dainis O. Martinsons, Saginaw, both of Mich.

[73] Assignee: General Motors Corporation, Detroit, Mich.

[21] Appl. No.: 857,010

[22] Filed: Mar. 25, 1992

[51] Int. Cl.[5] ..... G05G 1/14

[52] U.S. Cl. ..... 74/512; 74/513; 74/560

[58] Field of Search ..... 74/560, 512, 561, 514, 74/513, 522, 515 R, 562, 562.5; 192/99 S, 110 R

[56] References Cited

U.S. PATENT DOCUMENTS

| | | | |
|---|---|---|---|
| 3,151,499 | 10/1964 | Roe | 74/560 |
| 3,511,109 | 5/1970 | Tanaka | 74/560 |
| 3,643,524 | 2/1972 | Herring | 74/560 |
| 3,643,525 | 2/1972 | Gibas | 74/560 X |
| 3,828,625 | 8/1974 | Bruhn | 74/560 X |
| 3,995,510 | 12/1976 | Yost | 74/560 X |
| 4,424,719 | 1/1984 | Pretsch | 74/89.15 |
| 4,870,871 | 10/1989 | Ivan | 74/513 |
| 4,875,385 | 10/1989 | Sitrin | 74/512 |
| 4,949,590 | 8/1990 | Barker et al. | 74/512 |
| 5,010,782 | 4/1991 | Asano et al. | 74/512 |
| 5,067,368 | 11/1991 | Itakura et al. | 74/512 |
| 5,078,024 | 1/1992 | Cicotte et al. | 74/560 X |
| 5,086,663 | 2/1992 | Asano et al. | 74/513 X |

FOREIGN PATENT DOCUMENTS

| | | | |
|---|---|---|---|
| 0203020 | 10/1983 | German Democratic Rep. | 74/512 |
| 1113293 | 9/1984 | U.S.S.R. | 74/512 |

*Primary Examiner*—Vinh T. Luong
*Attorney, Agent, or Firm*—Ernest E. Helms

[57] ABSTRACT

A locationally adjustable pedal is provided for providing a force input to an automotive vehicle control. The adjustable pedal includes a crossbar having a rotational axis fixed with respect to the vehicle, an idler link having first and second ends, the first end being angularly fixed with respect to the crossbar, a top link having first and second ends with the first end pivotally connected with the crossbar with a pivotal axis generally coterminous with the rotational axis of the crossbar, a rear link with first and second ends with the first end pivotally connected to the top link second end, a pedal link pivotally connected with the second ends of the idler and rear links, the pedal link having a surface for operator contact, a rod link having a first end pivotally connected to the crossbar with a pivotal axis coterminous with the crossbar rotational axis, the rod link being angularly fixed with respect to the top link and the rod link having at a second end a pivotal connection with respect to the control rod, and a motor or hand wheel to adjust and fix the rotational position of the crossbar.

9 Claims, 3 Drawing Sheets

MODULE COCKPIT/SUPPORT STRUCTURE WITH ADJUSTABLE PEDALS

FIELD OF THE INVENTION

The field of the invention is that of a locationally adjustable actuator to provide the input to an automotive vehicle control. More particularly, the invention relates to a powered locationally adjustable pedal assembly which can provide locational adjustment of the pedals while at the same time providing independent inputs for the brake, accelerator and optional clutch controls.

DISCLOSURE STATEMENT

It has been known in the art in certain vehicles to provide pedal assemblies which are locationally adjustable. Prior adjustable pedal assemblies, manual or powered, usually provided certain deficiencies. First, usually upon adjustment of the pedal assemblies, the radius of curvature of the pedal arc input would change as the pedal was locationally adjusted. Secondly, it was very hard to provide adjustable pedals which could be adjusted in common while at the same time keeping their inputs independent from one another upon actuation.

It is desirable to provide an adjustable pedal assembly wherein the pedals make a general arc sloping downward towards the floor pan of the vehicle as the pedals are positioned backwards.

SUMMARY OF INVENTION

To provide an adjustable brake pedal assembly which overcomes the deficiencies aforedescribed and which proceeds beyond to parturition of advantages previously unreveled, the present invention is brought forth.

Others objects, desires and advantages of the present invention can become more apparent to those skilled in the art as the nature of the invention is better understood from the accompanying drawings and a detailed description.

DETAILED DESCRIPTION OF THE DRAWINGS

Figure 1:
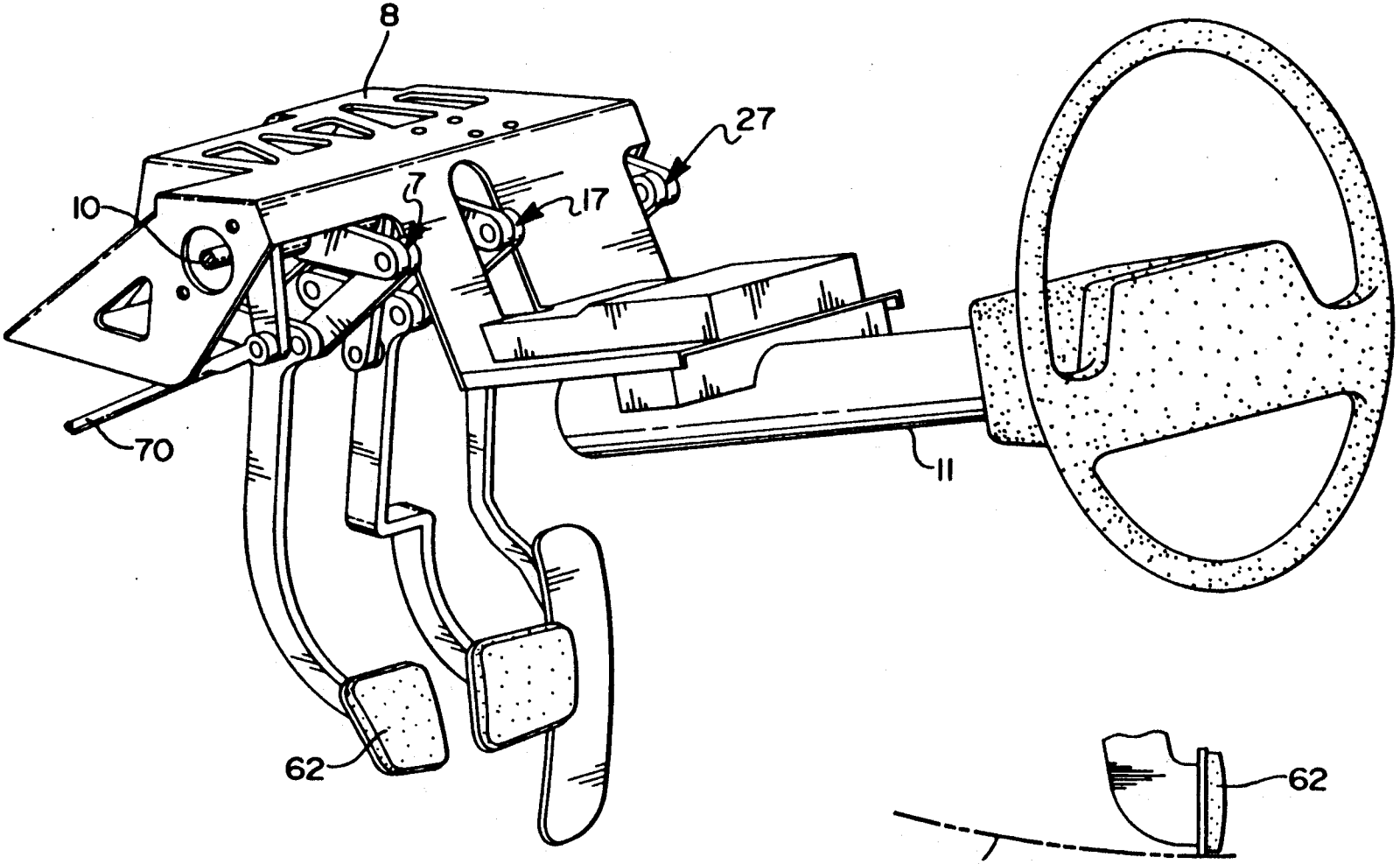
FIG. 1 is a perspective view of the preferred embodiment adjustable pedal assemblies according to the present invention joined to the steering wheel.

Referring to FIG. 1, the locationally adjustable pedal actuator assemblies 7, 17 and 27 of the present invention are connected with a frame module 8. The frame module 8 has connected thereto a steering column 11. Pedal assemblies 7, 17 and 27 are provided for a clutch, brake and accelerator of a motor vehicle.

Figure 2:
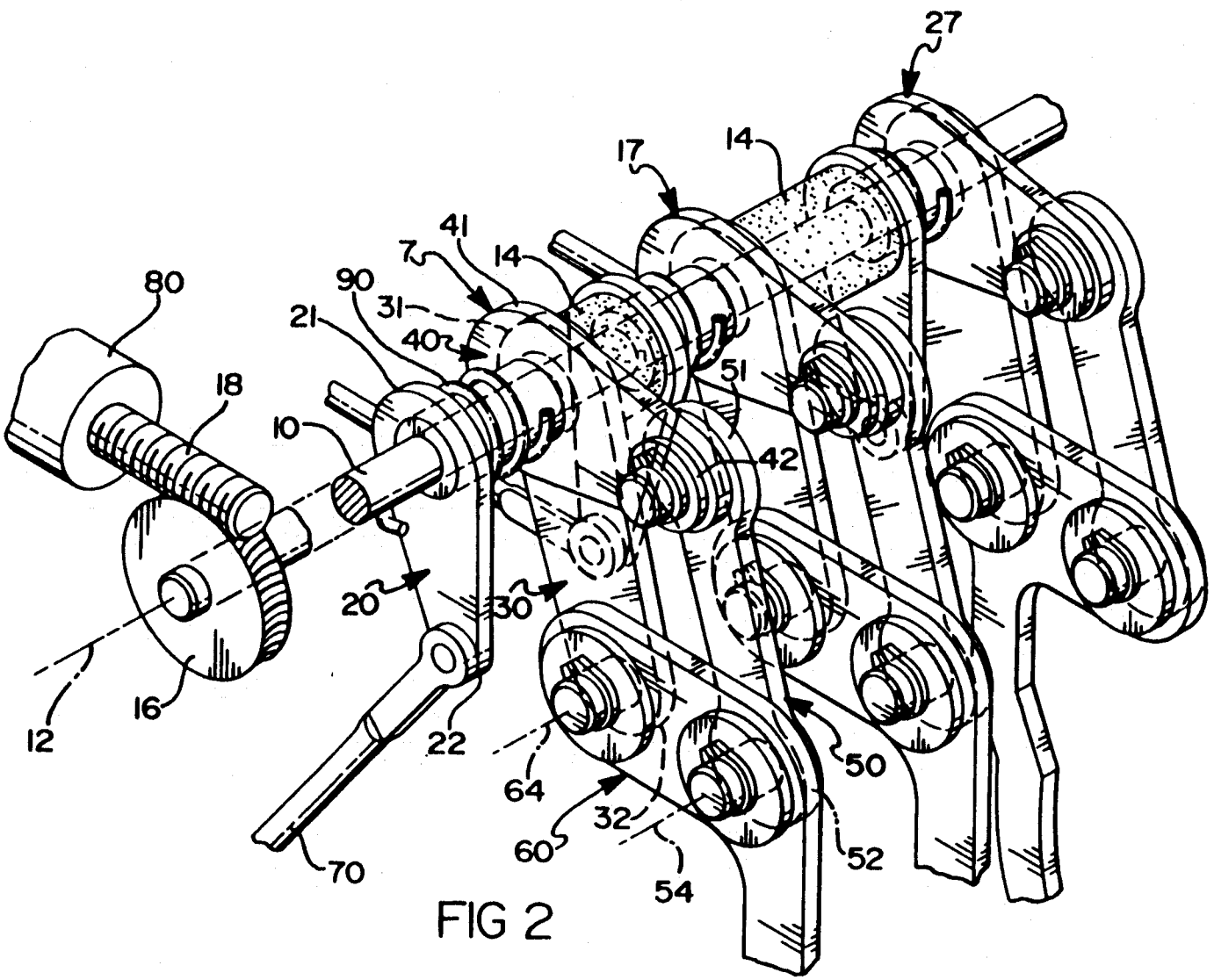
FIG. 2 is another perspective view of the pedal assemblies in FIG. 1.
Figure 3:
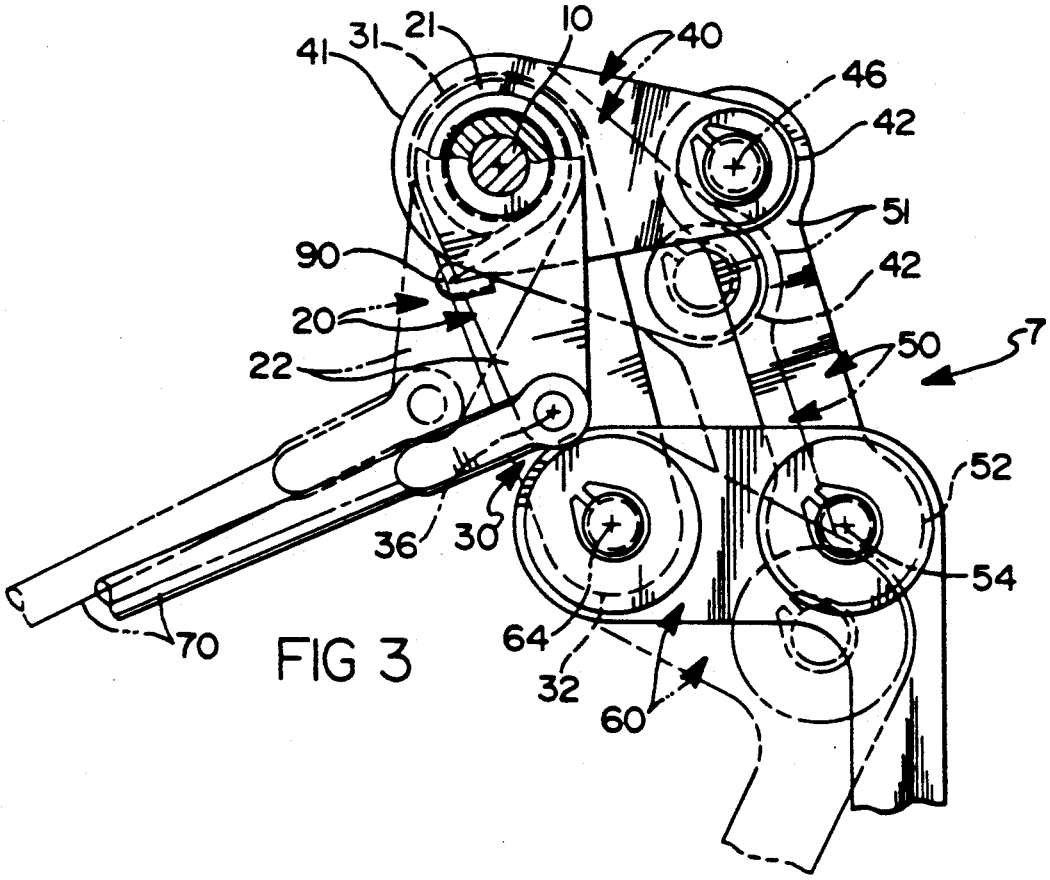
FIGS. 3 and 4 are operational views of one of the pedal assemblies of FIG. 1 shown in a forward and rearward positionally adjusted positions.
Figure 4:
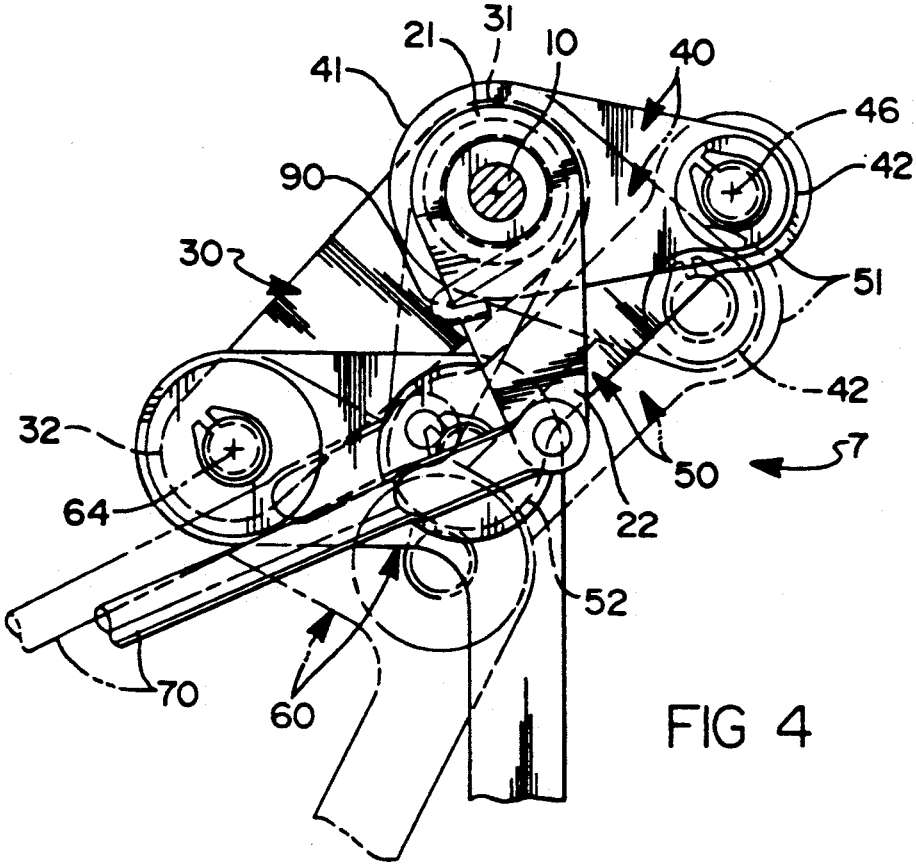

Referring additionally to FIGS. 2–4, the clutch pedal 62 has pivotally connected thereto an input force push rod 70 which is operatively associated with a clutch (not shown).

The frame 8 is fixably connected to or alternatively forms part of a dashboard of the vehicle. Rotatably mounted in the frame 8 by bushing 14 and having a rotational axis 12 fixed with respect to the vehicle is a crossbar 10. The crossbar 10 is common to all three of the pedal assemblies 7, 17, 27 and rotation of the crossbar 10 will cause positional adjustment in all three pedal assemblies 7, 17, 27 simultaneously.

The crossbar 10 has fixed thereto a first gear 16. The first gear 16 is mated with a worm gear 18 which is powered by an electric motor 80 to provide for locational adjustment of the pedal assemblies 7, 17, and 27. The gear ratio of the first gear 16 and worm gear 18 combination along with the lever ratio of the pedal 17 assure that an input from the pedal 7 will not be able to backdrive the worm gear 18. Therefore, in a quick stop the drivers force input and weight will not cause positional adjustment of the pedal 7 (beyond the normal movement of the pedal) due to rotation of the crossbar 10.

Typically the motor 80 will have a memory allowing the pedal 7 to automatically position itself according to the dictate of the driver and allow the pedal 7 to automatically revert to a most forward position upon termination of the vehicle ignition to allow easy exiting of the vehicle. In alternative embodiments the worm gear 18 may be driven by a remote motor via a cable drive system or be connected with a manual adjustment means such as a hand wheel or pedal ratchet to allow for manual adjustment.

Connected to the crossbar 10 in an angularly fixed manner is an idler link 30 which has first 31 and second 32 ends. The idler link 30 will move only during adjustment of the pedal assembly 7. Pivotally connected to the crossbar 10 with a pivotal axis coterminous with the rotational axis 10 of the crossbar is a top link 40. The top link 40 is pivotally connected with the crossbar 10 at its first end 41. The top link 40 in all positions of adjustment will be in an identical position. A second end 42 of the top link is pivotally connected with a first end 51 of a rear link 50. Pivotally connected to the second ends 32, 52 of the idler link 30 and the rear link 50 is a pedal link 60. The pedal link 60 forms a parallelogram with the idler link 30, top link 40 and rear link 50. The pedal link has connected thereto a pedal with a contact surface for the vehicle operator, typically a foot pad 62 (FIG. 1).

Having a pivotal axis which is coterminous with the rotational axis 12 of the crossbar 10 is a rod link 20. The rod link 20 is pivotally associated with the crossbar 10 at its first end 21 and at its second end 22 is pivotally connected with the clutch control rod 70. The rod link 20 is also angularly fixed with respect to the top link 40 and therefore will be locationally fixed along all positions of adjustment so long as the pedal 7 is not being utilized. Therefore the point of pivotal attachment of the rod link 20 with the rod 70 must remain in the same during all locales of adjustment of the pedal 7.

Connected on the crossbar 10 is a torsion spring 90 which biases the rod link 20 to a retracted position As mentioned previously, the idler link 30, rear link 50, top link 40 and pedal link 60 form a parallelogram. Therefore in any adjusted position, actuation of the pedal 7 will cause the foot pad 62 of the pedal 7 to pivot along a constant radius with respect to its pivotal connection 64 with the idler link 30. Therefore in any position of adjustment, the movement of the foot pedal 7 will be the same to the vehicle operator. Typically, vehicle operations find this constant feel to be preferable.

During clutch actuation, the idler link 30 as mentioned previously will remain steady and the pivotal connection 46 of the top link 40 with the rear link 50 will tend to move towards the pivotal connection 64 of the idler link 30 with the pedal link 60 causing the parallelogram to collapse (shown in phantom in FIGS. 3 and 4). The above noted movement will cause the pivotal connection 36 of the rod link 20 with the rod 70 to be driven forward and the clutch will be activated. Upon removal of the operator's foot from the pedal 7, the torsion spring 90 will cause the rod link 20 to move to a retracted position to restore the pedal 7 to its prior unactivated position. The above events all occur totally independent of the brake 17 and accelerator pedal 27 assemblies.

To adjust all of the pedal assemblies 7, 17 and 27 simultaneously requires only that the crossbar 10 be rotated and then affixed in its new position. This is accomplished by rotation of the worm gear 18 which is engaged with the first gear 16 which is in turn torsionally associated with the crossbar 10. The above movement causes the parallelogram of the links 30, 40, 50 and 60 to move by moving the idler link 30 thereby causing the rear link 50 to move in unison. The top link 40 will be stationary during this time and the pivotal connections 64 and 54 of the pedal link 60 with the idler link 30 will remain parallel with the pivotal connections 10 and 46 of the top link 40 and the rear link 50.

Figure 5:
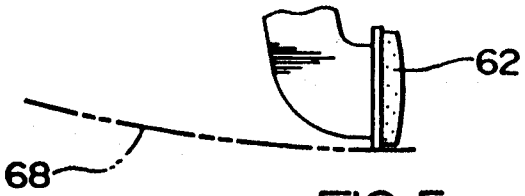
FIG. 5 is a projected adjustment path of the pedal assemblies.

If plotting the motion of travel of the foot pad 62 as the pedal 7 is adjusted from its rearmost position (FIG. 3) to the foremost position (FIG. 4) the foot pad projects a curvilinear downward sloping path 68 (FIG. 5). The projected path 68 has been found to be superior for an ergonomic point of view. However, path 68 may be modified if so desired by modification of the lengths of the respective link.

As mentioned previously, adjustment in the position of the crossbar 10 moves all the pedal assemblies 7, 17, 27 in unison, therefore, the spacing or alignment between the pedal assemblies 7, 17, 27 remains constant.

While an embodiment of the present invention has been explained it will be readily apparent to those skilled in the art of the various modifications which can be made to the present invention without departing from the spirit and scope of this application as it is encompassed by the following claims.

We claim:

1. A locationally adjustable actuator for providing a force input to a rod operatively associated with an automotive vehicle control, the actuator in combination comprising:

a crossbar having a rotational axis fixed with respect to the vehicle;

an idler link having first and second ends, the first end being angularly fixed with respect to the crossbar;

a top link having first and second ends with the first end pivotally connected with the crossbar with a pivotal axis generally coterminous with the rotational axis of the crossbar;

a rear link with first and second ends with the first end pivotally connected to the top link second end;

a pedal link pivotally connected with the second ends of the idler and rear links, the pedal link having a surface for operator contact;

a rod link having a first end pivotally connected to the crossbar with a pivotal axis coterminous with the crossbar rotational axis, the rod link being angularly fixed with respect to the top link and the rod link having at a second end a pivotal connection with respect to the control rod; and means to adjust and fix the rotational position of the crossbar.

2. An actuator as described in claim 1 further including spring means biasing the rod link to a retracted position.

3. An adjuster as described in claim 1 further including power means to adjust the rotational position of the crossbar.

4. An actuator as described in claim 1 wherein in any position the pedal link rotates in a constant radius upon input by the operator upon the surface for operator contact.

5. An actuator as described in claim 4 wherein the idler link, top link, pedal link and rear link form a parallelogram.

6. An actuator as described in claim 1 wherein said crossbar is torsionally associated with a first gear which is driven by a worm gear to provide the means to adjust and fix the rotational position of the crossbar.

7. An actuator as described in claim 1 for a plurality of vehicle operator controls with each actuator acting independent each actuator having the elements of idler, rear, top, pedal and rod links on a common crossbar independently provided for an individual input to a vehicle control, such pedals being positionally adjusted in unison upon the adjustment of the rotational position of the crossbar.

8. A powered locationally adjustable pedal for providing a force to an input rod operatively associated with a vehicle control, the locationally adjustable pedal in combination comprising:

a crossbar having a rotational axis fixed with respect to the vehicle and having connected at its end a first gear;

an idler link having first and second ends, the first end being angularly fixed with respect to the crossbar;

a top link having a first and second ends with the first end connected along a pivotal axis with the crossbar coterminous with the crossbar rotational axis;

a rear link with first and second ends with the first end pivotally connected to the top link second end;

a pedal link pivotally connected with the second ends of the idler and rear links, forming a parallelogram with the idler, rear, top and pedal links having a surface for contact with the foot of the vehicle operator;

a rod link having a first end pivotally connected with the crossbar along the crossbar rotational axis, the rod link being angularly fixed with the top link and the rod link having a second end for pivotal connection with the rod of the vehicle control;

a worm gear threadably associated with the first gear;

means to power the worm gear to adjust the position of the pedal and at the same time in all adjusted positions providing a constant radius of rotation when using the pedal to activate the vehicle control; and means to bias the rod link to a retracted position.

9. A locationally adjustable pedal as described in claim 8 further including a second locationally adjustable pedal for second vehicle control with an associated input rod and a second set of idler, top, pedal, read and rod links connected in a manner similar as that previously described and providing an independent input to the second vehicle control, however, the second pedal being locationally adjusted simultaneously upon rotation of the crossbar.

* * * * *